US006758123B2

(12) United States Patent
Svetlik et al.

(10) Patent No.: US 6,758,123 B2
(45) Date of Patent: Jul. 6, 2004

(54) BEVEL ANGLE DETENT SYSTEM FOR A COMPOUND MITER SAW

(75) Inventors: Kenneth Svetlik, Schaumburg, IL (US); Mark Kuras, Des Plaines, IL (US); Abbas Javanshad, Skokie, IL (US); Yi-Te Liao, Nan-Tou (TW); Chih-Young Huang, Nan-Tou (TW)

(73) Assignee: S-B Power Tool Corporation, Broadview, IL (US)

( * ) Notice: Subject to any disclaimer, the term of this patent is extended or adjusted under 35 U.S.C. 154(b) by 56 days.

(21) Appl. No.: 10/271,432

(22) Filed: Oct. 16, 2002

(65) Prior Publication Data

US 2004/0074363 A1 Apr. 22, 2004

(51) Int. Cl.[7] ..... B26D 1/16

(52) U.S. Cl. ..... 83/471.3; 83/473; 83/477.1; 83/490; 83/581

(58) Field of Search ..... 83/471.3, 473, 83/477.1, 486.1, 581, 698.31, 698.41, 490, 564; 403/112, 113, 117

(56) References Cited

U.S. PATENT DOCUMENTS 5,235,889 A 8/1993 Brickner et al.
5,582,089 A * 12/1996 Sasaki et al. ..... 83/471.3
5,623,860 A 4/1997 Schoene et al.
5,819,624 A 10/1998 Brault et al.
5,862,734 A 1/1999 Brunson et al.
5,865,079 A 2/1999 Itzov
5,870,938 A 2/1999 Brunson et al.
5,907,987 A * 6/1999 Stumpf et al. ..... 83/471.3
5,931,073 A 8/1999 Hoyer-Ellefsen
5,988,031 A 11/1999 Wixey
6,016,732 A 1/2000 Brault et al.
6,101,914 A 8/2000 Brunson et al.
6,397,716 B1 * 6/2002 Garuglieri ..... 83/471.3
RE38,122 E * 5/2003 Kondo et al. ..... 83/471.3
2001/0042429 A1 11/2001 Brunson et al.

* cited by examiner

*Primary Examiner*—Thomas J Druan, Jr.
(74) *Attorney, Agent, or Firm*—Gardner Carton & Douglas LLP

(57) ABSTRACT

A miter saw is provided having a support arm that is pivotally mounted to a base for adjustment of a pivot angle, the saw including a detent mechanism to provide pivot stops at common bevel angles, such as at 45° L, 0° (vertical), and 45° R. The detent mechanism includes a step-shaped, arcuate detent block mounted to the support arm in an adjustable manner to permit the accurate setting of the block in a home position. In an embodiment, a pair of set screws acts against opposite ends of the detent block, permitting precise adjustment in either direction. An axially movable detent pin is mounted to the base to contact against stepped surfaces of the block. The arm is free to pivot within a bevel angle range defined by one of the surfaces. Steps between surfaces act as a pivot stops, abutting the pin at a corresponding predetermined angle of the arm.

21 Claims, 7 Drawing Sheets

BEVEL ANGLE DETENT SYSTEM FOR A COMPOUND MITER SAW

FIELD OF THE INVENTION

The invention generally relates to power tools and more particularly relates to a miter saw having a pivotable support arm with a detent mechanism to provide pivot stops at certain bevel angles.

BACKGROUND OF THE INVENTION

Power miter saws are generally known. Typically, a power miter saw includes a base having a fixed support platform having a rip fence and a turntable that is rotatably mounted to the base, a movable arm assembly extending from the turntable, and power saw unit mounted to the arm for cutting a workpiece on the turntable. To make standard miter cuts, the arm holds the saw unit so that its circular blade is generally vertical.

A compound miter saw additionally includes a bevel angle joint that permits the angular adjustment of the arm to hold the blade at a bevel angle, generally between 0–45 degrees from vertical. Detent mechanisms are generally known for locking the bevel angle joint at common angles, for example 0, 33.9 or 45 degrees, however, an improved detent mechanism is desired. Some known detent mechanisms include steps integrated into the structure of the support arm, wherein the bevel angle is limited by contact of one of the steps against detent pin. It is desirable to provide a miter saw having a step-like detent mechanism that permits easy adjustment of the position of one or more of the steps relative to the arm to facilitate fine adjustment of a corresponding pivot stop position.

BRIEF SUMMARY OF THE INVENTION

The invention provides an improved compound miter saw which permits precise adjustment of detent steps that correspond to bevel angle stops. For example, in an embodiment, a compound miter saw is provided which includes: a base; a movable support arm assembly for holding a tool unit, the support arm having a hub portion that is rotatably mounted to the base to permit rotation of the support arm relative to the base along an axis; a detent block having a plurality of generally parallel, planar surfaces adjacent surfaces are positioned at different axial depths relative to each other so that the adjacent surfaces are separated by a respective step; a detent pin carried by the base for movement in a direction generally parallel to the axis and generally perpendicular to the surfaces; and a biasing element urging the detent pin into contact against one of the surfaces; wherein each surface defines a range of possible bevel angle positions of the support arm, and the step can abut the pin to limit a pivoting of the support arm at a corresponding predetermined bevel angle and wherein the detent block is adjustably mounted to the support arm to permit adjustment of the position of the step relative to the support arm. Preferably, each of the steps is planar and radially oriented relative to the axis.

In an embodiment, the hub portion includes a recess shaped to receive the block and to provide space for adjustment of the block either clockwise or counterclockwise relative to a center of the hub. The hub further includes fasteners, such as set screws, to secure the detent block at a desired position.

In an embodiment, the compound miter saw further includes a linkage operable to move the detent pin. With the linkage, a user can retract the detent pin to clear one of the steps, permitting the support arm to move to a bevel angle beyond the pivot stop defined by the respective step. Preferably, the linkage includes a handle is positioned generally at a side of the base which is generally opposite of the hub.

In an embodiment, the detent block is generally arcuate, and wherein the detent block is mounted to the hub generally concentrically to the axis.

In an embodiment, at least one of the steps includes a threaded bevel angle adjustment bolt to adjust the bevel angle at which the step contacts the detent pin.

An advantage of the present invention is that it provides an improved compound miter saw.

Another advantage of the present invention is that it provides a compound miter saw in which a "home" bevel angle position, such as a vertical (0°) position, is precisely adjustable.

A further advantage of the present invention is that it provides a compound miter saw that has few parts and which is simple to assemble in a precise manner.

Yet another advantage of the present invention is that it provides a compound miter saw having a tiltable support arm, wherein pivot stops can be released by a linkage actuatable from a front of a saw. A related advantage is that the miter saw of the invention provides enhanced safety, avoiding a need for a user to reach around or over the saw to move a detent pin located near a rear of the saw.

Additional features and advantages of the present invention are described in, and will be apparent from, the following description, figures and claims.

DETAILED DESCRIPTION OF THE PRESENTLY PREFERRED EMBODIMENTS

Figure 1:
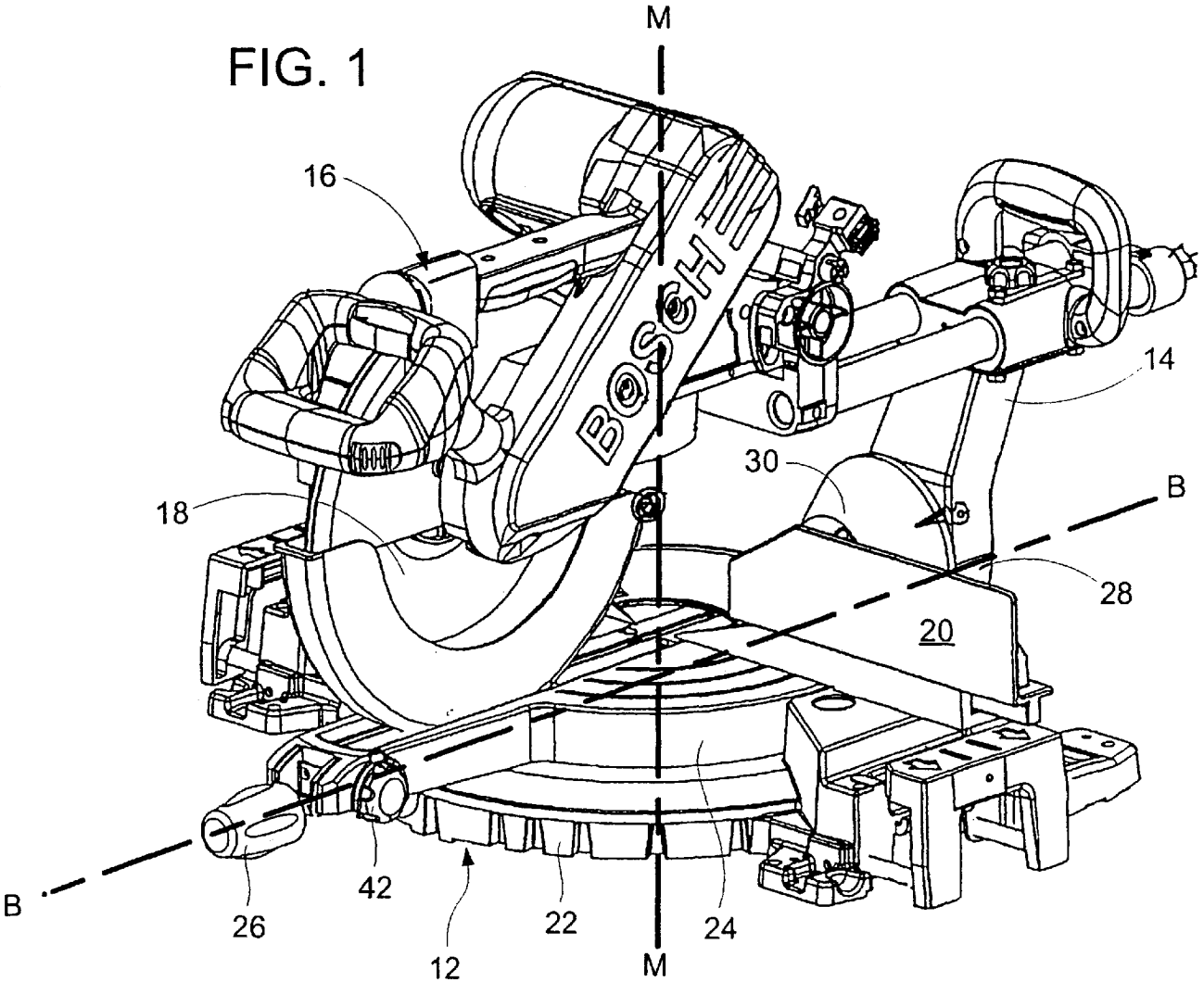
FIG. 1 is a perspective view of a compound miter saw having features in accordance with teachings of the present invention.

Referring now to the drawings, wherein like numerals designate like components, FIG. 1 illustrates an exemplary compound miter saw 10 incorporating features according to teachings of the present invention.

As illustrated in FIG. 1, the miter saw 10 generally includes a base 12, a movable support arm 14 pivotably mounted to the base, and a tool unit 16. As illustrated, the tool unit 16 is a power saw having a circular blade 18. The base 12 is configured to support a workpiece and, in an embodiment, the base includes a rip fence 20 to hold the workpiece.

The miter saw is constructed so that the angle of the blade 18 can be varied for cutting the workpiece. For angular adjustment of the saw blade 18 on a "miter angle" about a vertical miter axis M, still referring to FIG. 1, the base 12 includes a stationary portion 22 that is supported on a stationary surface, such as a workbench (not shown) and, and a turntable 24 that is rotatably mounted to the stationary portion 22. The position of the turntable 24 corresponds to the miter angle of the saw blade 18 relative to the rip fence 20 on the base 12. A turntable handle 26 is provided for selection of the miter angle.

Figure 2:
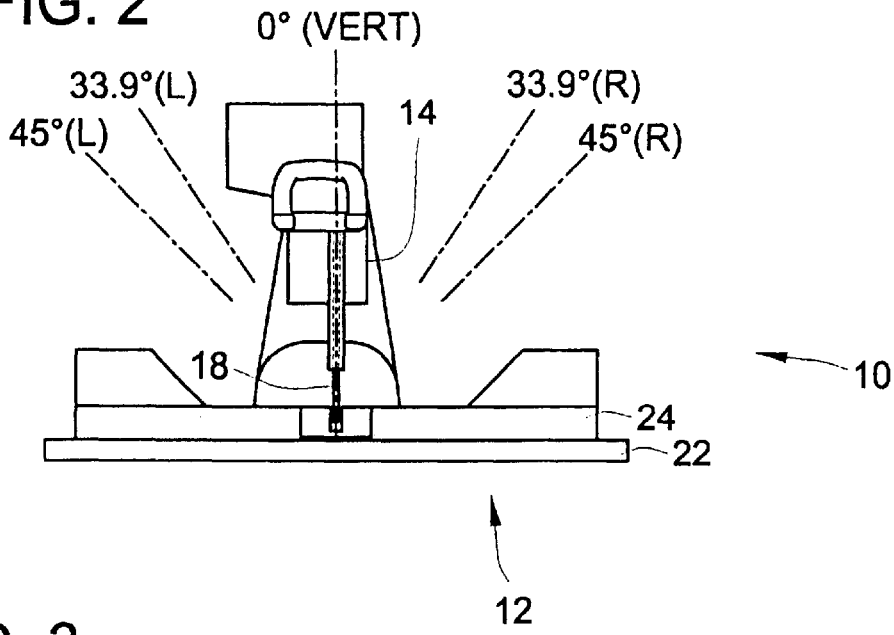
FIG. 2 is a schematic front elevational view of the saw, showing exemplary saw blade bevel angles of 45° L, 33.9° L, 0°, 33.9° R and 45° R to which the support arm can be pivoted.

For angular adjustment of the tool unit on a "bevel angle" about a horizontal bevel axis B, the support arm 14 is pivotally mounted to the base 12. More specifically, the support arm 14 has a hub portion 28 (FIGS. 1 and 3) that is rotatably mounted to a pivot housing portion 30 (FIG. 1) of the turntable 24 to permit rotation of the support arm 14 relative to the turntable 24 about the bevel axis B. In order to selectively hold the tool unit 16 at certain common bevel angles, the miter saw 10 includes a detent mechanism, described below in greater detail. For example, FIG. 2 schematically illustrates saw blade bevel angles of 45° L, 33.9° L, 0°, 33.9° R and 45° R at which the detent mechanism provides pivot stops of the support arm 14. The detent mechanism also permits the support arm to be tilted within certain angular ranges between the pivot stops.

The detent mechanism includes a stepped detent block that is adjustably mounted to the support arm and which is selectively engageable by a movable detent pin carried by the turntable. According to an aspect of the invention, the position of the detent block can be adjusted relative to the hub portion to result in a precise setting of a "home" position of the support arm, such as the 0° (vertical) position.

Figure 4:
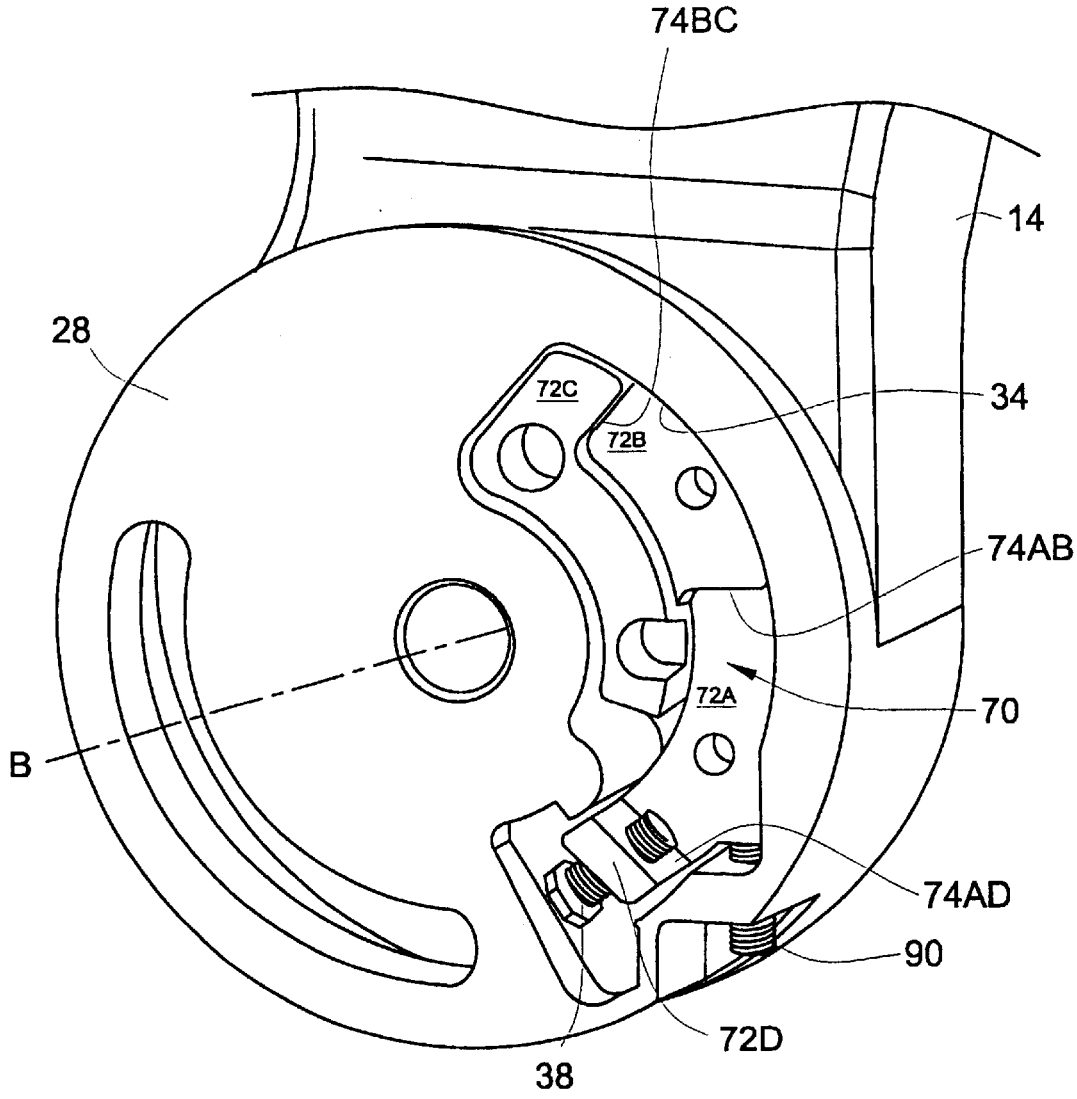
FIG. 4 is a fragmentary, perspective view of the support arm, showing a front of the hub and detent block mounted thereto.
Figure 5:
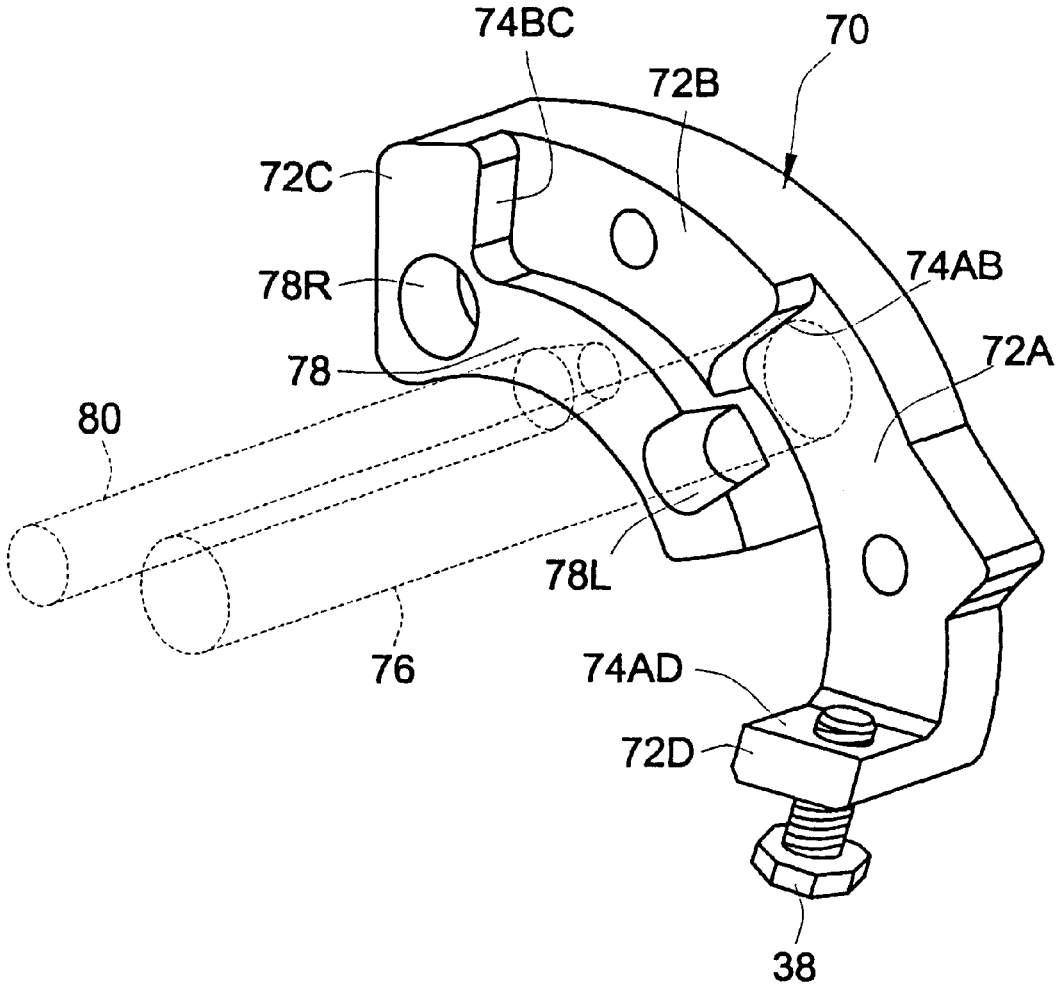
FIG. 5 is a schematic, perspective view of the detent block, detent pin, and auxiliary pin.

In an embodiment as illustrated in FIGS. 4 and 5, the detent block 70 has a stepped profile. More particularly, the detent block 70 has a series of forwardly facing surfaces 72A, 72B, 72C, 72D arranged next to each other at a common radius from the bevel axis B about which the support arm 14 pivots. The detent block 70 preferably has an arcuate shape. Acting with a detent pin 76, the detent block 70 defines pivot stops to selectively restrict pivot arm from moving beyond certain bevel angles.

To define pivot stops, adjacent surfaces of the detent blocks are at different relative axial positions to define steps. For example, in the exemplary embodiment of FIGS. 4 and 5, the adjacent surfaces 72A and 72B are separated by a step 74AB, the adjacent surfaces 72B and 72C are separated by a step 74BC, and the adjacent surfaces 72A and 72D are separated by step 74AD. Each of the steps 74AB, 74BC and 74AD permits the detent block 70 to move along a particular arc of motion, limiting the angular freedom of the support arm 14 accordingly.

Figure 3:
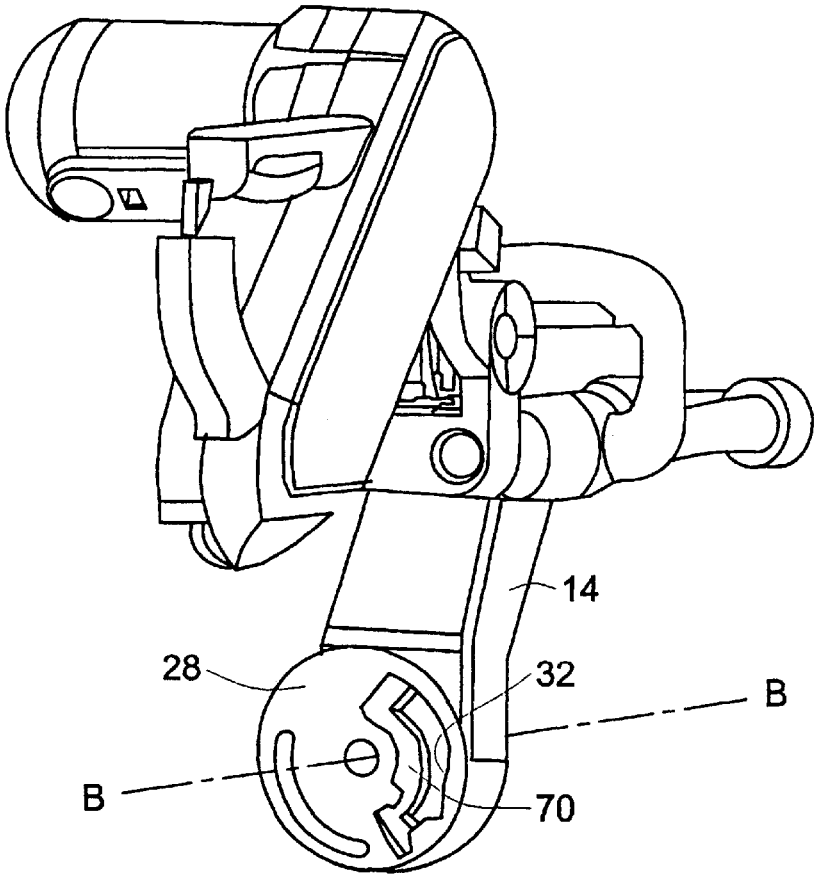
FIG. 3 is a perspective view of a support arm and a portion of the tool unit, showing a front of the hub and detent block mounted thereto.

FIG. 5 schematically illustrates a detent pin 76 that acts against the detent block 70 to limit motion of the support arm 14 (FIGS. 1 and 3). The detent pin 76 is movably mounted to the turntable 24 (FIG. 1) to axially extend or retract relative to the surfaces 72A–D. The detent pin 76 is positioned at generally the same radius from the axis B as the surfaces 72A–D so that a tip of the pin 76 can contact perpendicularly against any one of the surfaces. A point of engagement of the detent pin 76 against the detent block 70 corresponds to a bevel angle position of the support arm 14.

The detent pin 76 is biased toward the detent block 70, so that the tip of the pin 76 can slide in contact a respective one of the surfaces 72A–D when the support arm is pivoted. Accordingly, the support arm 14 is free to pivot within a current bevel angle range as limited by contact of the detent pin 76 against the steps 74AB, 74BC, and an end of bolt 38 adjustably fixed to step 74AD. When the detent pin 76 is in contact against any one of the surfaces 72A–D, the support arm 14 is free to pivot within an angular range permitted sliding contact of the detent pin 76 against the respective surface. Additionally, the support arm 14 can freely pivot so that the detent pin 76 skips over one of the steps 74AB, 74BC, or 74AD to be received against an adjacent surface that is "deeper." For example, when the detent block 70 is positioned so that the surface 72B is contacted by the detent pin 76, the support arm 14 (FIGS. 1, 3) can be pivoted so that the detent pin 76 skips over the step 74AB moves to contact with the surface 72A, which is deeper than surface 72B. The detent pin 76 automatically extends to reside at the depth defined by the deeper surface 72A. However, the support arm 14 is prevented from freely pivoting beyond a point where the pin 76 contacts a step to one of the surfaces that is "higher." For example, with reference to FIG. 5, when the detent block 70 is positioned so that the surface 72A is contacted by the detent pin 76, the support arm 14 stops rotating when the detent pin 76 contacts the step 74AB to the "higher" surface 72B. The steps 74BC and 74AD similarly act to stop the support arm when brought into contact against the detent pin 76.

Each of the steps 74AB, 74BC and 74AD acts as a pivot stop at a predetermined bevel angle of the support arm 14. In typical use, commonly needed bevel angles are 0° (vertical) and 45° from vertical. Therefore, the detent block 70 is designed and positioned so that the step 74AB defines a pivot stop a at support arm angle of 0° (vertical), step 74BC defines a pivot stop at a support arm angle of 45° to the left, and 74AD defines a pivot stop at a support arm angle of 45° to the right. As a result, the surface 72A permits a bevel angle range of 0° to 45° to the left, the surface 72B permits a bevel angle between 0°+ to 45° to the right.

So that a user can pivot the support arm beyond a pivot stop angle, the detent pin 76 can be retracted as needed to clear one of the steps to a "higher" surface. For example, if the tip of the detent pin 76 resides on surface 72A, at which the pivot arm is positioned at a 0° bevel angle, the pin 76 can be retraced to clear the step 74AB, permitting the support arm to pivot into the bevel angle range permitted by surface 72B (0° to 45° left) The support arm to be pivoted to a bevel angle such that the pin an adjacent surface of the detent block that is less deep.

The detent block is adjustably mounted to the support arm to permit adjustment of the position of the step relative to the support arm. Referring to FIG. 3, the hub portion 28 includes a recess 32 shaped to receive the detent block 70. The recess 32 is preferably arcuate to generally correspond to the shape of the detent block 70, although the recess 32 has a dimensions which are permit opposite ends of the detent block to move. In one embodiment, the recess can have one or more openings through which respective portions of the block can project.

Figure 6:
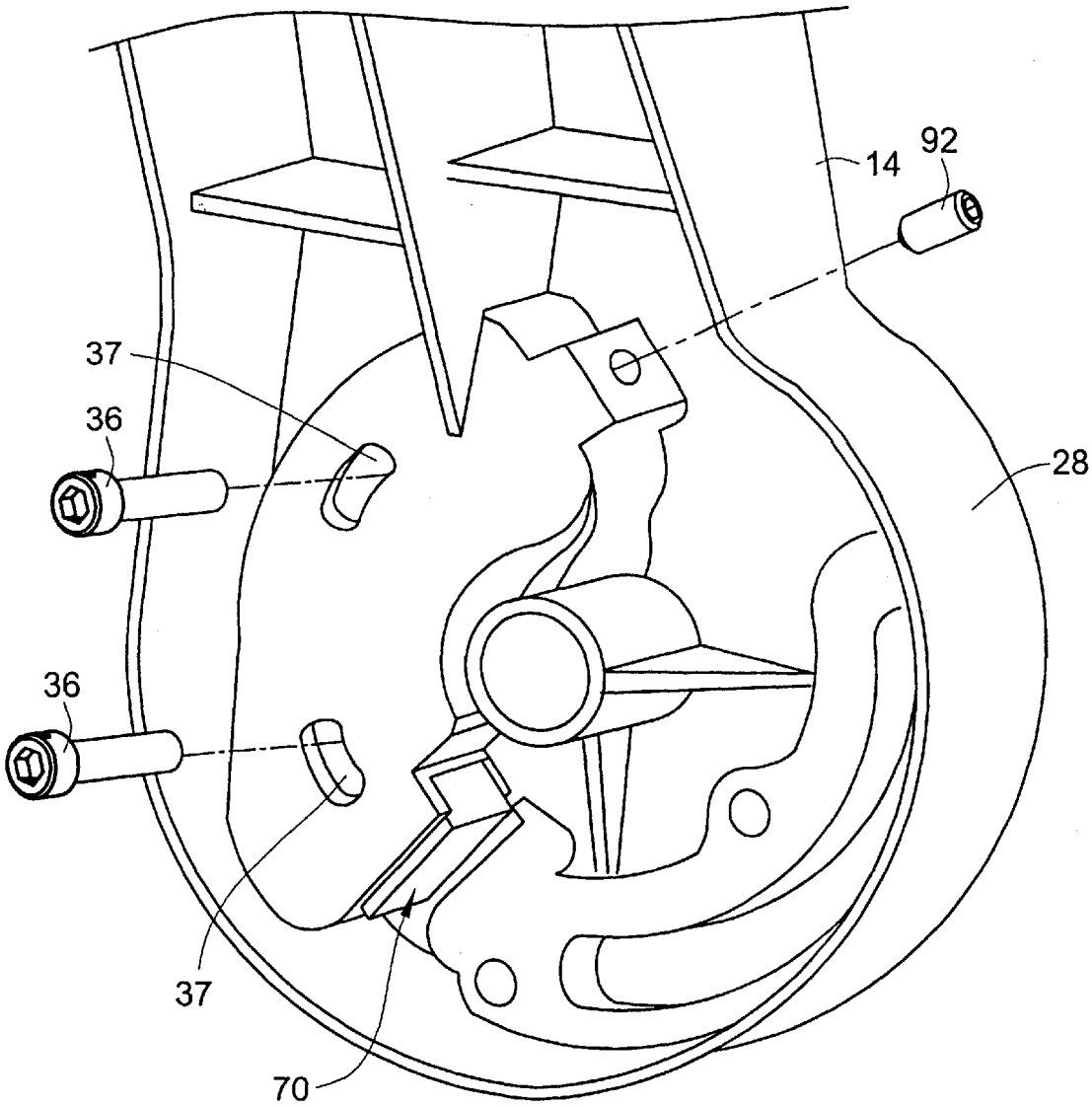
FIG. 6 is a fragmentary, perspective view of a rear side of the support arm.

At least one fastener is provided to secure the detent block within the recess. For example, in an embodiment as illustrated in FIG. 6, detent block is secured with a pair of threaded set screws 36. Each of the set screws 36 extends through a corresponding elongate hole 37 the hub portion 28 and is threaded into a bore in a rear side of the detent block 70.

The detent block 70 can be adjusted by loosening the set screws 36, adjusting fine adjustment screws 90 and 92 to appropriately position the detent block 76 within the recess, and then tightening the set screws 36. The saw is most commonly operated in the 0° position, the home position. Therefore, it is desirable that the fine adjustment screws 90, 92 (FIG. 6) are adjusted to position the detent block 70 relative to the hub portion 28 so that the step 74AB shown in FIGS. 4 and 5 corresponds to the 0° (vertical) position of the support arm 14. When the set screws 36 are loosened, the block 70 can shift from side to side as permitted by the fine adjustment screws 90, 92 which adjustably secure against opposite ends of the block 70. Once the fine adjustment screws 90, 92 are appropriately set, the set screws 36 at the back of the block can be secured.

In an embodiment, one or more of the steps is adjustable independently relative to the adjustment of the entire block. For example, as illustrated in FIG. 5, the step 74AD of the detent block 70 includes an adjustment bolt 38. The adjustment bolt 38 can be extended or retracted as necessary to set a pivot stop for a bevel angle of 45° to the left. The adjustment bolt 38 permits the 45° (L) position to be adjusted without affecting the overall position of the block 70 or the corresponding 0° setting.

Occasionally, it is desirable to make a bevel cut that is greater than 45°, for example, to cut a molding for a corner that is not square. With reference to FIG. 5, to permit the support arm to be moved beyond 45°, the detent pin 76 can be retracted to clear either step 74AD (with adjustment bolt 38) or step 74BC so that the detent pin resides against surface 72D or 72C, respectively. When the detent pin 76 clears bolt 38 and step 74AD to the surface 72D, the support arm 14 is permitted to move to a bevel angle beyond 45° to the left, for example to about 47°, as limited by adjacent structure to prevent further movement. When the detent pin 76 clears step 74BC, the support arm 14 is permitted to move to a bevel angle beyond 45° to the right, for example to about 47°.

Figure 7:
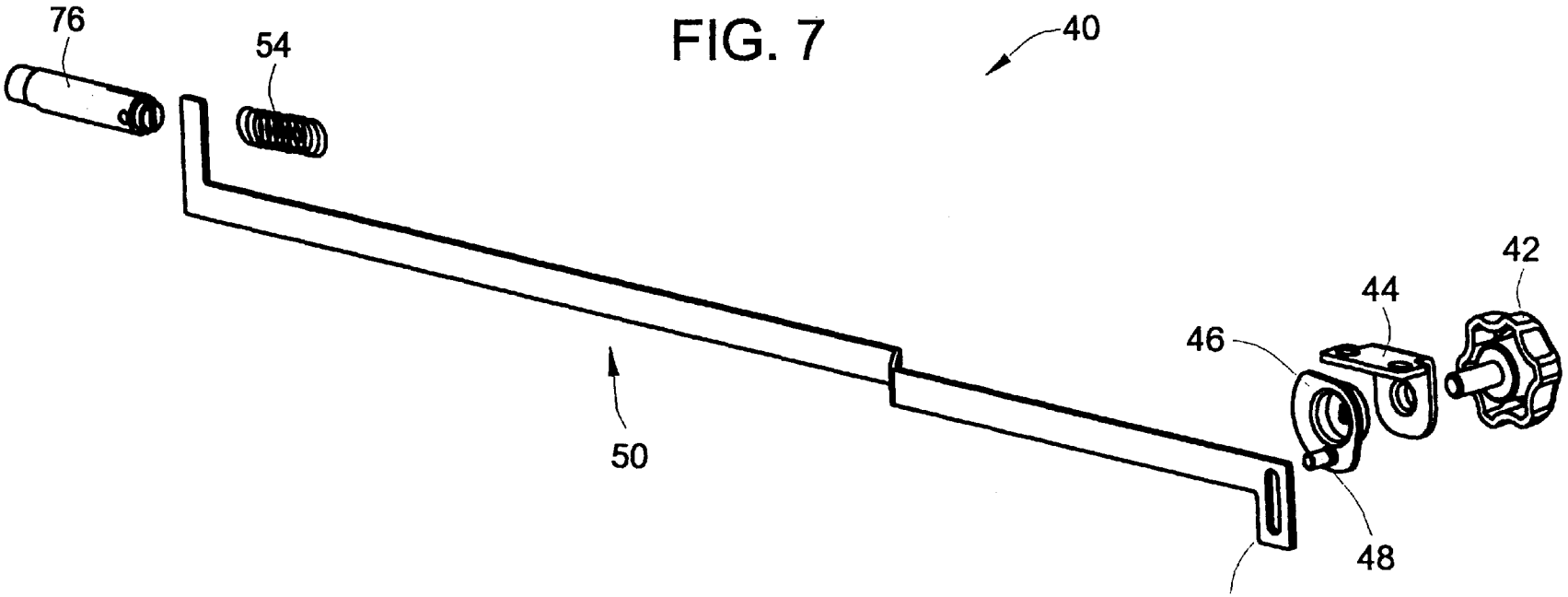
FIG. 7 is an exploded, perspective view of a linkage for retracting the detent pin.
Figure 8:
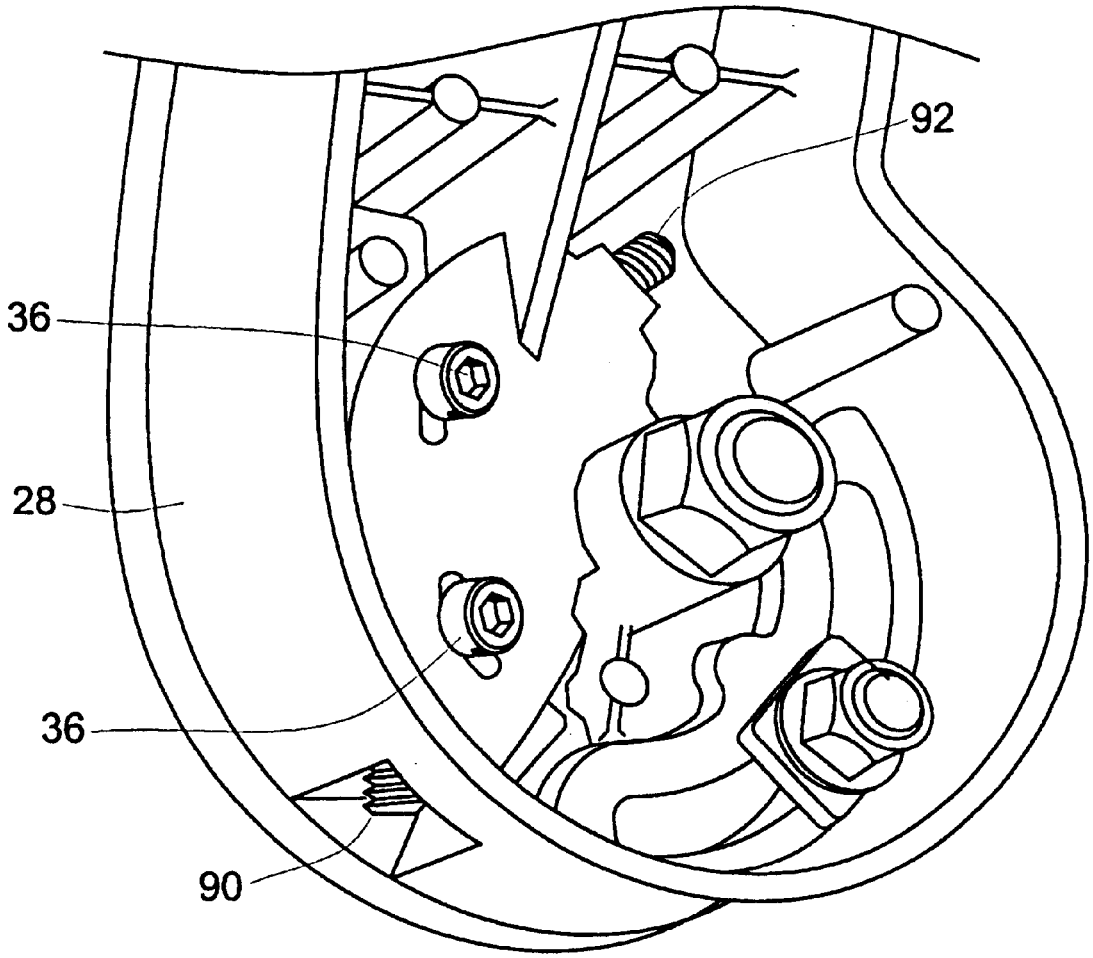
FIG. 8 is a fragmentary view of a rear side of the support arm from a different perspective than FIG. 6.

An embodiment of the invention includes a linkage for moving the detent pin. An exemplary linkage 40 is illustrated in FIG. 7, including a knob 42 that is mounted in a conveniently accessible manner at a front of the saw (see FIG. 1). The knob 42 is held rotatably by a bracket 44 that is secured against an underside of the turntable 24. A crank 46 having an eccentric peg 48 is fixed to the knob 42. A rod 50 is slidably mounted along an underside of the turntable 24. The rod 50 has a proximal end with a vertical slot 52 that receives the eccentric peg 48. The rod 42 has a distal end 48 that is mounted to the detent pin 76. When the knob 42 is rotated, the crank 46 rotates to vary the position of the eccentric peg 48 along a circular path. The peg 48 applies a force against the edges of the slot 52 so that a horizontal component of motion is translated to the rod 50. As a result, rotation of the knob 42 is operable to extend or retract the detent pin 76. The detent pin 76 is actuatable by the knob 42 positioned generally at the front of the miter saw 10, thereby advantageously improving safety by avoiding a need for user to reach over the saw in order to adjust the bevel angle.

A coil spring 54 is provided in compression against the detent pin 76 to urge the detent pin 76 toward the detent block (FIG. 5). More particularly, one end of the spring 54 is positioned against a proximal end of the detent pin 76 and an opposite end of the spring 54 is positioned against the base 12.

The knob 42 is configured to operate in three positions. In a first position, the linkage 40 permits the detent pin 76 to move to the deepest surface 72A. Because the detent pin 76 is urged toward the detent block 70, the detent pin 76 will tend to find the deepest detent surface 72A, which defines a most often needed bevel angle range of 0° to 45° to the left. For example, if the pivot arm is positioned so that the detent pin 76 contacts any of the higher surfaces 72B, 72C, or 72D, the pin automatically steps downward as a user pivots the support arm toward the position defined by 72A. When a user turns the knob 42 to a second position, the detent pin is retracted a sufficient distance to clear the step 74AB, but not enough to clear the steps 74AD (with bolt 38) or 74BC, permitting the pivot arm to move to the right as much as 45°. When a user turns the knob 42 to a third position, the detent pin 76 is retracted a sufficient distance to clear the steps 74AD (with bolt 38) or 74BD, permitting a user to move the support arm to a bevel angle greater than 45° to the left or right, respectively.

For certain types of crown molding or other specialty applications, it is desirable to make a cut at a specific bevel angle, for example 33.9°, to achieve a correct corner fit. To provide a pivot stop at an auxiliary angle such as 33.9°, the detent block 70 has an auxiliary surface 78 having a pair of auxiliary detent holes 78L and 78R, as shown in FIG. 5. An auxiliary pin 80 is carried on the base movement to extend or retract perpendicularly to the auxiliary surface 78. Normally, the auxiliary pin 80 is locked in a retracted position clear from the auxiliary surface 78 of the detent block 70. However, when a user desires to lock the support arm 14 at the auxiliary angle, the auxiliary pin 80 is released so that is biased against the auxiliary surface 78. As the arm 14 is pivoted in the vicinity of the desired auxiliary bevel angle, the auxiliary pin 80 will find the auxiliary detent hole 78L or 78R. locking the support arm at the corresponding auxiliary bevel angle. In the embodiment illustrated in FIG. 5, the detent holes 78L and 78R correspond to auxiliary bevel angles of 33.9° to the left and 33.9° to the right of vertical, respectively.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. Although the invention is described in the context of a compound miter saw, one skilled in the art will understand from the figures, claims, and description herein that the principles of the present invention may be equally applicable to various other powered or unpowered devices in which a detent mechanism is useful to provide angular adjustment of a tool unit relative to a workpiece. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A power tool comprising:

a base;

a movable support arm assembly for holding a tool unit, the support arm having a hub portion rotatably mounted to the base to permit rotation of the support arm relative to the base along an axis;

a detent block having a plurality of generally parallel, planar surfaces, and at least one step, each of the steps separating respectively adjacent surfaces at different axial depths relative to each other;

a detent pin carried on the base for movement in a direction generally parallel to the axis and generally perpendicular to the surfaces; and a biasing element urging the detent pin against the detent block;

wherein each surface defines a range of possible bevel angle positions of the support arm, and each at least one step can abut the pin to limit motion of the support arm at a corresponding predetermined bevel angle; and wherein the detent block is adjustably mounted to the support arm to permit adjustment of the position of the step relative to the support arm.

2. The power tool of claim 1, wherein the detent block is a unitary structure.

3. The power tool of claim 1, wherein the hub portion includes a recess shaped to generally receive the detent block, the power tool further comprising at least one fastener operable to secure the detent block relative to the hub portion.

4. The power tool of claim 3, wherein the hub portion includes at least one elongate hole through the hub portion in a generally concentric orientation relative to the axis, and wherein the fastener is a set screw extending through the elongate hole and threaded into the detent block.

5. The power tool of claim 1, further comprising a linkage operable to move the detent pin.

6. The power tool of claim 5, wherein the linkage includes a knob positioned generally at a side of the base that is opposite of the hub, wherein movement of the knob is operable to move the detent pin.

7. The power tool of claim 1, wherein the detent block is generally arcuate, and wherein the detent block is mounted to the hub generally concentrically to the axis.

8. The power tool of claim 1, further comprising a threaded bolt extending through at least one of the steps to adjust the bevel angle of the support arm at which the step contacts the pin.

9. The power tool of claim 1, wherein the step is radially oriented relative to the axis and generally perpendicular to the surfaces.

10. The power tool of claim 1, wherein the tool unit is a saw having a circular blade.

11. The power tool of claim 1, wherein the block is mounted for adjustable movement relative to the arm, the power tool further comprising a pair of fine adjustment screws, each of the screws threaded through the arm to contact against the block, the screws respectively contacting the block generally in opposite directions, wherein the screws permit adjustment of the predetermined bevel angle.

12. The power tool of claim 1, further comprising a threaded adjustment bolt extending through the step at a position contact the detent pin, rotation of the bold varying the predetermined bevel angle.

13. A compound miter saw comprising:

a base;

a support arm pivotably mounted to the base for pivotable motion about an axis, the support arm supporting a saw having a circular blade;

a detent block mounted to the support arm, the detent block having a series of stepped surfaces arranged concentrically relative to the axis, adjacent surfaces being separated from each other by a respective step; and a detent pin movably mounted to the base and aligned to contact perpendicularly against one of the surfaces, the support arm being free to pivot in a bevel angle range permitted by the pin along a respective one of the surface, at least one of the steps defining a respective pivot stop corresponding to a bevel angle of the support arm at which the detent pin abuts the step;

wherein the block is mounted to the support arm in a manner such that the detent block is adjustably movable to a selected fixed position to vary the bevel angle of the support arm at which the detent pin abuts the step.

14. The compound miter saw of claim 13, wherein the support arm includes a recess shaped to generally receive the block, and further including at least one fastener operable to secure the detent block relative to the support arm.

15. The compound miter saw of claim 14, wherein the support arm includes at least one elongate hole extending to the recess, and wherein the fastener is a set screw extending through the elongate hole and threaded into the detent block.

16. The compound miter saw of claim 13, further comprising a linkage operable to move the detent pin.

17. The compound miter saw of claim 1, wherein the linkage includes a knob positioned generally at a side of the base that is opposite of the hub, wherein movement of the knob is operable to move the detent pin.

18. The compound miter saw of claim 15, wherein the detent block is generally arcuate, and wherein the detent block is mounted to the support arm generally concentrically to the axis.

19. The compound miter saw of claim 15, further comprising a threaded bolt extending through the step to adjust the bevel angle of the support arm at which the pin abuts the step.

20. The compound miter saw of claim 13, wherein further comprising a biasing element to urge the detent pin toward the detent member.

21. The compound miter saw of claim 13, wherein each of the steps is oriented generally radially relative to the axis.

* * * * *